United States Patent [19]

Covington et al.

[11] Patent Number: 4,695,768

[45] Date of Patent: Sep. 22, 1987

[54] BIMETAL SWITCH FOR ELECTRODE HEAT CUTOUT WITHIN AN ELECTRICALLY INSULATING SUPPORT

[75] Inventors: Edward J. Covington, Highland Hts.; John E. Cridland, Cleveland Hts.; John P. Gorman, Mentor, all of Ohio

[73] Assignee: General Electric Company, Schenectady, N.Y.

[21] Appl. No.: 810,616

[22] Filed: Dec. 19, 1985

[51] Int. Cl.[4] ..... H01J 7/44; H01J 17/34

[52] U.S. Cl. ..... 315/73; 315/49; 315/50; 315/100; 315/99; 315/98; 315/DIG. 5; 313/49; 313/51; 313/623; 313/493

[58] Field of Search ..... 315/49, 50, 100, 99, 315/98, 73, DIG. 5; 313/49, 51, 623, 493

[56] References Cited

U.S. PATENT DOCUMENTS

| | | | |
|---|---|---|---|
| 2,462,335 | 2/1949 | Reinhardt | 315/100 |
| 2,517,493 | 5/1985 | Dembowski et al. | 315/73 |
| 3,519,872 | 5/1967 | Ward | 315/49 |
| 4,135,114 | 1/1979 | Narikiyo | 315/DIG. 5 |
| 4,345,186 | 8/1982 | Saito et al. | 315/100 |
| 4,481,446 | 11/1984 | Tsuchihashi et al. | 315/100 |
| 4,510,418 | 4/1985 | Anderson, Jr. et al. | 315/73 |

*Primary Examiner*—David K. Moore
*Assistant Examiner*—Michael J. Nickerson
*Attorney, Agent, or Firm*—Nathan D. Herkamp; Edward M. Corcoran; Philip L. Schlamp

[57] ABSTRACT

A fluorescent lamp electrode heat cutout switch is provided for placement within a fluorescent lamp stem and outside the discharge envelope and is configured such that a resistive heater wire is connected to one electrode lead-in and a bimetallic switch element is connected to the other electrode lead-in and configured upon an insulating support in such fashion that the heat cutout switch receives heat from the resistive heater to activate the switch so that the electrode heat is cut off when the lamp starts and is kept off during normal lamp operation.

28 Claims, 3 Drawing Figures

BIMETAL SWITCH FOR ELECTRODE HEAT CUTOUT WITHIN AN ELECTRICALLY INSULATING SUPPORT

BACKGROUND OF THE INVENTION

1. Field of the Invention

The present invention relates to electrode heat cutout devices for fluorescent lamps, and, more particularly, to an electrode heat cutout switch mechanism employing a heat-responsive cutout switch connected to one lamp electrode lead and a resistive heater connected to the other lamp electrode lead.

2. Description of the Prior Art

Certain types of fluorescent lamps, e.g., rapid start type, are provided with cathode heating current for heating the cathode to electron-emitting temperature, so that the lamps start quickly without damaging the electron-emitting material deposited on the electrodes. This electrode heating consumes about 1½ to 2 watts of electrical power per electrode during normal lamp operation. While the lamps are operating, "hot spots" form on the electrodes and can provide adequate electron emission without the need for continuing to supply heating current through the electrode. Therefore, about 3–4 watts of electrical energy per lamp are used to heat the lamp electrodes during operation rather than contributing to light output, resulting in the unproductive use of a considerable amount of energy, particularly in lighting systems in large buildings having hundreds or even thousands of fluorescent lamps. One prior art approach to electrode heat cutout is described in U.S. Pat. No. 4,517,493 issued May 14, 1985 to Dembowski et al and assigned to the assignee of the present case. The Dembowski et al patent discloses a rapid start fluorescent lamp provided with a pair of cathode mounts each having a pair of lead-in wires for cathode heating current, and a thermal switch mounted inside the lamp envelope to turn off the heating current after sufficient initial cathode heating and during operation of the lamps. A third lead-in wire is provided in each mount and is used to bypass the thermal switch for heating the cathodes to activate the emission mix during manufacture. After activation of the cathode, the third lead-in wire is not used, and the selected pairs of lead-in wires are connected to terminals of the lamp's end cap bases. In a lamp configuration such as shown in Dembowski et al, the insertion of the bimetal switch into the lamp envelope adds additional manufacturing steps to the lamp manufacturing. Another prior art starting switch for electric discharge lamps is disclosed in U.S. Pat. No. 2,462,335, issued Feb. 22, 1949 to B. R. Reinhardt and assigned to the assignee of the present case. The Reinhardt patent describes a switch mechanism in which two bimetal elements having separate thermal characteristics are employed to provide a fast-acting and slow-acting switch to enable both hot and cold lamp restart. In the Reinhardt patent, the switch mechanism is designed so that the slow-acting component will be heated indirectly by heat from the lamp discharge, and the fast-acting component is heated by a heating circuit. This complexity makes the switch arrangement of Reinhardt less attractive due to the number of components necessary to assemble in the manufacturing of the lamp.

SUMMARY OF THE INVENTION

An object of the present invention is to provide a cutout switch for controlling electrode heating for fluorescent lamps which is disposed outside the lamp envelope and operates reliably to control the application of heating current to the lamp electrodes. A more particular object of the present invention is to provide a cutout switch mechanism having a heater disposed in close proximity to a heat-responsive switch mechanism, so that precise control of the operation of the switch is obtained.

Accordingly, the present invention comprises, briefly and in a preferred embodiment, an electrode heat cutout switch mechanism having a heat-responsive switch element connected to one lead-in wire of a fluorescent lamp electrode and a heater element connected to the other lead-in wire of the fluorescent lamp electrode and placed in close proximity to the switch element so that the heater element provides a controlled amount of heat to the switch element to control the opening and closing of the switch. In a particularly preferred embodiment of the present invention, the switch comprises a bimetal switch element, and the heater element comprises a nichrome resistance wire disposed in close proximity to the switch element.

BRIEF DESCRIPTION OF THE DRAWINGS

Further objects and advantages of the present invention together with its organization, method of operation, and best mode contemplated may best be understood by reference to the following description taken in conjunction with the accompanying drawings in which.

DESCRIPTION OF THE PREFERRED EMBODIMENTS

Figure 1:
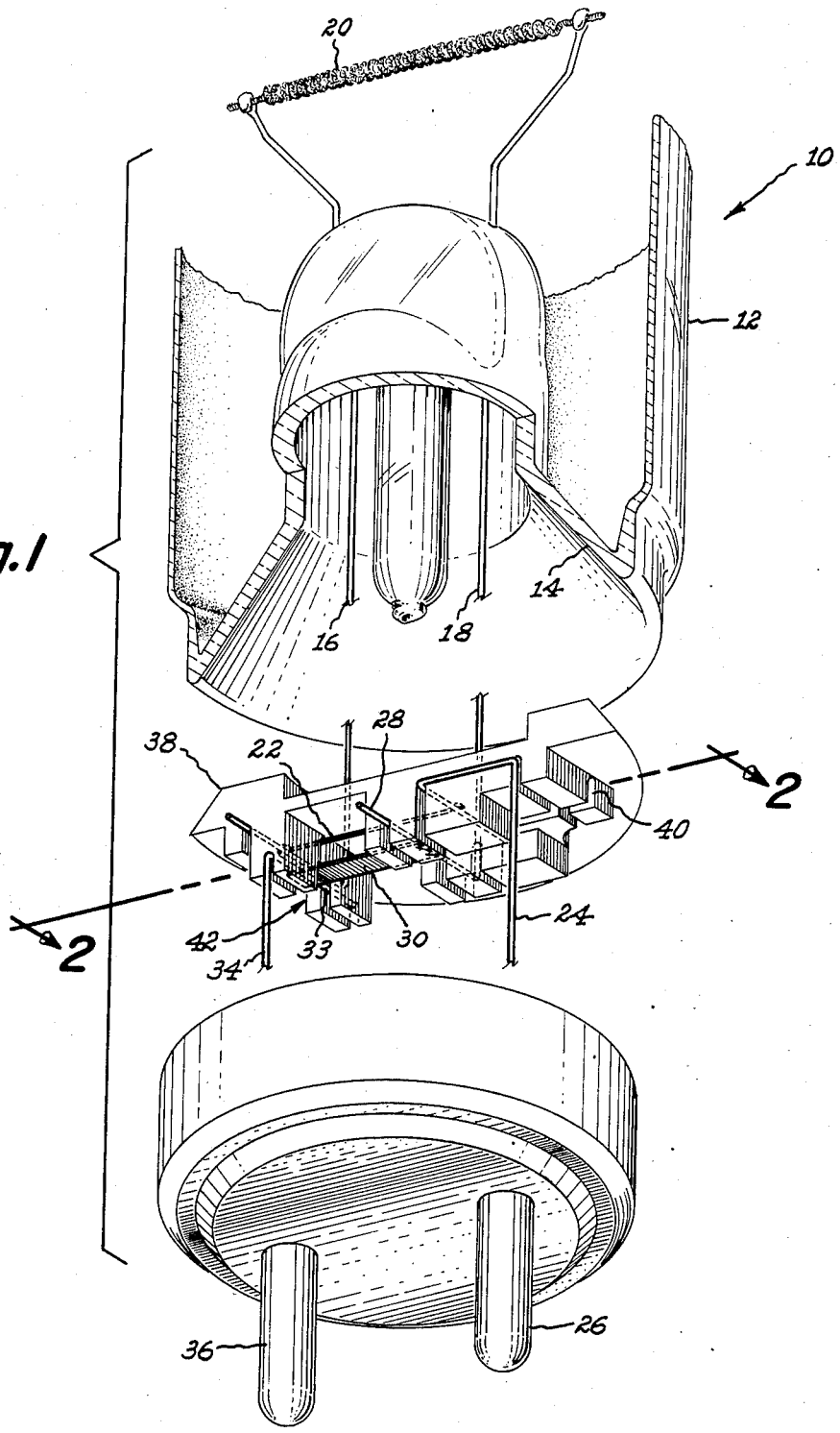
FIG. 1 is a schematic exploded view with some parts in section of a fluorescent lamp end incorporating the electrode heat cutout switch mechanism of the present invention.
Figure 2:
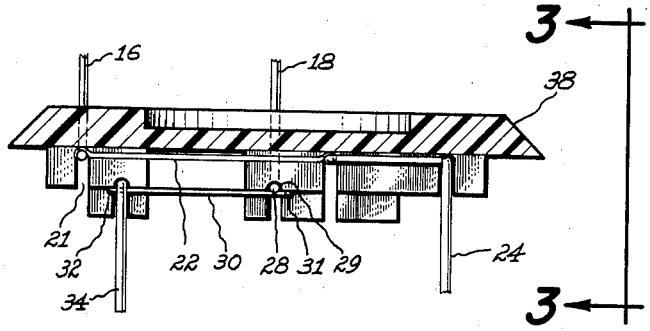
FIG. 2 is a schematic partial cross-sectional view of the heat cutout switch mechanism of the present invention taken along line 2—2 of FIG. 1.
Figure 3:
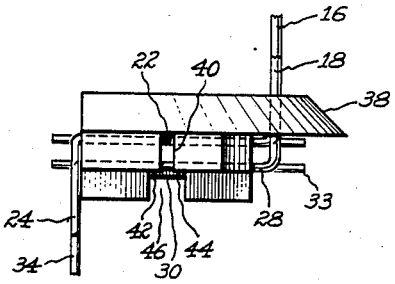
FIG. 3 is a schematic end view of the heat cutout switch mechanism of the present invention taken at line 3—3 of FIG. 2.

FIG. 1 shows an exploded view of one end of a standard fluorescent lamp 10 including a tubular glass envelope 12 having a stem 14 closing the end of the glass tube 12. A pair of lead-in wires 16, 18 are sealed within the glass stem 14 and provide electrical connection through the stem to the lamp electrode 20. The lead-in wire 16 passes through nonconductive support 38 and is connected to one end of heater element 22 in channel 21 as shown in FIG. 2. The other end of heater element 22 is connected to terminal wire 24 which is connected to terminal pin 26 of the bipin base. Lead 18 passes through support 38 and is bent to form a terminal 28 in channel 29 which is connected, e.g. by welding, to one end 31 of switch element 30. In the closed position, switch element 30 contacts at its other end 32 a portion 33 of terminal wire 34 which is connected to terminal pin 36. As shown in FIG. 3, support member 38 provides a mounting mechanism to secure the heater element 22 and the heat-responsive switch element 30 in predetermined proximity to each other by selecting the spacing between the slot 40 for holding the heater element 22 and the shoulders 42, 44 of channel 46 for holding the switch element 30. The spacing between the bottom of the slot 40 and shoulders 42, 44 defines the distance separating the heater element 22 from the switch element 30. The spacing between the interior surface of the slot 40 and the channel 46 is selected based on the heating characteristics of the heater element and the heat-responsive characteristics of the switch element, so that the heat form the heater element 22 is efficiently transferred to the switch element 30 to operate the switch. The bimetal switch element may comprise either a flat strip as shown or a generally U-shaped member configured to make contact with the lead-in wire connected to the lamp electrode. The arrangement of the present invention facilitates final lamp assembly, because the switch mechanism can be completely assembled separate from the lamp and then be connected at final assembly to the lamp stem prior to installation of the end caps. Further, because the switch is located outside the lamp envelope, selection of switch materials may be made without considering how the switch material would be affected by contact with the internal operating environment of the lamp.

The switch of the present invention operates as follows: When electrical power is applied to the pins 26, 36 of the lamp base, heating current is applied to the lamp electrode 20 via terminal wire 24, heater element 22, lead-in wire 16 and lead-in wire 18, switch element 30 and terminal wire 34. The electrode 20 is heated to electron-emitting temperature, and then an arc is established between the electrodes at the opposite ends of the fluorescent lamp. Current flowing through heater wire 22 will produce enough heat to cause switch element 30 to deflect to the open position after the lamp starts stopping the flow of electrode heating current. In the normal lamp operating condition the lamp current flows continuously through the heater wire 22 to maintain the switch element 30 in the open position. When the lamp is turned off, heat from the wire 22 quickly dissipates and the switch element 30 quickly cools to reclose so that electrode heating current may again be applied to the electrode 20 for restarting the lamp. By locating the switch outside the lamp, the heater element 22 and switch element 30 cool quickly to allow rapid restart. The heater element and switch element can be chosen to provide both a proper amount of heat to the lamp electrode for starting and a quick response at turn off.

In one embodiment used to test the present invention the heater element 22 was a nichrome wire of a diameter of approximately 0.003 inches. The switch element 30 comprised a bimetal having a thickness of 0.005 inches, a width of 2 millimeters and a length of 12 to 15 millimeters comprising two layers of metal having different coefficients of thermal expansion with the material having the greater coefficient of thermal expansion being the layer adjacent the nichrome heater wire. The heater wire will typically consume about 0.15 watts during normal operation. Therefore, the net energy saved will be the electrode heat power less the heater wire power or about 1.35–1.85 watts per electrode or about 2.7–3.7 watts per fluorescent lamp. The present invention provides a switch including a mount holding the resistive heater and the heat-responsive switch element so that the resistive heater wire is spaced relative to the switch element to achieve control of electrode heating current with minimum electrical power consumption, and which can be conveniently handled and assembled.

As will be obvious to those skilled in the art, the present invention provides an electrode heat cutout switch mechanism easily assembled in the end of a fluorescent lamp without requiring any modification of the lamp itself or its manufacturing process, which provides accurate control of fluorescent lamp electrode heating.

What we claim as new and desire to secure by Letters Patent of the United States is:

1. Apparatus for fluorescent lamp electrode heat cutout for use outside the envelope of such lamp comprising:

a bipin fluorescent lamp base comprising an end cap having a pair of lamp terminal pins attached thereto;

fluorescent lamp stem means comprising fluorescent lamp electrode means, a glass stem member for being sealed to the wall of said envelope and supporting said electrode means and first and second lead-in wire means each attached to respective ends of said electrode means, with said lead-in wire means being sealed into said glass stem member and extending therethrough for connecting said electrode means to a source of electrical power;

a normally closed heat-responsive bimetal switch element comprising a first layer of emtal disposed adjacent a resistance wire heater element and having a first coefficient of thermal expansion and a second layer of metal bonded to a surface of said first layer and having a second coefficient of thermal expansion less than said first coefficient of thermal expansion for connecting one of said lead-in wire means to a respective one of said terminal pins electrically in series when closed;

a resistance heating wire element connected in electrical series with the other of said lead-in wire means and the other of said pair of terminal wire means connected to the other respective one of said terminal pins for applying heat to said heat-responsive bimetal switch; and an electrically insulating support means for supporting both said bimetal switch element and said heating element in heat exchange relationship.

2. The invention of claim 1 wherein said heater element comprises:

a nichrome wire having a diameter of approximately 0.003 inches.

3. The invention of claim 1 wherein:

said bimetal strip comprises a two layer strip having a total thickness of approximately 0.003 inch, a width of approximately 0.040 inch and a length of approximately 0.290 inch.

4. The apparatus of claim 1 wherein said heating element is disposed in a slot in said support means.

5. The apparatus of claim 4 wherein said bimetal switch element is located in a channel in said support adjacent said heating element.

6. The apparatus of claim 5 wherein said channel has shoulders for supporting said bimetal switch element and wherein said shoulders terminate in said slot containing said heating element.

7. The apparatus of claim 1 wherein said metal layer of said bimetal switch element having said smaller coefficient of thermal expansion is disposed more remote from said heating element than said metal layer having said greater coefficient of thermal expansion.

8. The apparatus of claim 6 wherein said metal layer of said bimetal switch element having said smaller coefficient of thermal expansion is disposed more remote from said heating element than said metal layer having said greater coefficient of thermal expansion.

9. The apparatus of claim 8 wherein said support means is in the form of a disc.

10. A fluorescent lamp comprising an elongated glass envelope sealed at each end by a lamp stem with each of said lamp stems supporting an electrode within said envelope and containing first and second lead-in wires extending through each stem to provide operating current to each electrode and at least one thermally operated switch located outside said glass envelope for turning off heating current to at least one of said electrodes after the lamp has reached operating conditions, said switch comprising a support of electrically insulating material containing both a resistance wire heating element and a bimetal switch element comprising two different metal layers bonded to each other which have different coefficients of thermal expansion, said bimetal switch element disposed adjacent said heating element in predetermined heat exchange relationship with said heating element, wherein current is provided to one end of one electrode through said heating element, wherein the other end of said electrode is connected to current through said bimetal switch element and wherein said heating element causes said bimetal switch element to break electrical contact with one end of said electrode when said lamp has reached operating conditions.

11. The lamp of claim 10 further comprising an end cap attached to each end of said glass envelope and wherein said switch is located within at least one of said end caps.

12. The lamp of claim 11 wherein said switch heating element is disposed in a slot in said support.

13. The lamp of claim 12 wherein said bimetal switch element is located in a channel in said support adjacent said heating element.

14. The lamp of claim 13 wherein said channel has shoulders for supporting said bimetal switch element and wherein said shoulders terminate in said slot containing said heating element.

15. The lamp of claim 11 wherein the metal layer of said bimetal switch element which has the greater coefficient of thermal expansion is closer to said heating element than the other metal layer.

16. The lamp of claim 15 wherein said bimetal switch element is located in a channel in said support adjacent said heating element.

17. The lamp of claim 16 wherein said channel has shoulders for supporting said bimetal switch element and wherein said shoulders terminate in a slot containing said heating element.

18. A fluorescent lamp electrode heat cutout device for use outside the lamp envelope which comprises a support of electrically insulating material supporting both a resistance wire heating element and a bimetal switch element disposed in predetermined heat exchange relationship with said heating element, whereby current is provided to one end of an electrode in said lamp through said bimetal switch element and whereby current is supplied to the other end of said electrode is said lamp through said heating element and wherein said heating element causes said bimetal switch element to break electrical contact with one end of said electrodes when said lamp has reached operating conditions.

19. The device of claim 18 wherein said bimetal switch element comprises two different metal layers bonded to each other which have different coefficients of thermal expansion.

20. The devices of claim 19 wherein said bimetal switch element is located in a channel on said support adjacent said heating element.

21. The device of claim 20 wherein said channel has shoulders for supporting said bimetal switch element and wherein said shoulders terminate in a slot containing said heating element.

22. The device of claim 21 wherein the metal layer of said bimetal switch element which has the greater coefficient of thermal expansion is closer to said heating element than the other metal layer.

23. The device of claim 19 wherein said support is in the form of a disc.

24. The device of claim 22 wherein said support is in the form of a disc.

25. The apparatus of claim 1 wherein said electrically insulating support means is connected to one of said lamp stems.

26. The apparatus of claim 9 wherein said electrically insulating support means is connected to one of said lamp stems.

27. The lamp of claim 10 wherein said switch is connected to a lamp stem.

28. The lamp of claim 17 wherein said switch is connected to a lamp stem.

* * * * *